US007992323B2

(12) United States Patent
Lin

(10) Patent No.: US 7,992,323 B2
(45) Date of Patent: Aug. 9, 2011

(54) STRUCTURE OF VENTILATING INSOLE

(76) Inventor: Chung-Jen Lin, Huwei Township, Yunlin County (TW)

( * ) Notice: Subject to any disclaimer, the term of this patent is extended or adjusted under 35 U.S.C. 154(b) by 471 days.

(21) Appl. No.: 11/512,428

(22) Filed: Aug. 30, 2006

(65) Prior Publication Data

US 2007/0074424 A1 Apr. 5, 2007

(30) Foreign Application Priority Data

Sep. 2, 2005 (TW) ..... 94215282 U

(51) Int. Cl.
*A43B 7/06* (2006.01)

(52) U.S. Cl. ..... 36/3 R; 36/3 B

(58) Field of Classification Search ..... 36/3 R, 36/3 B, 43, 44
See application file for complete search history.

(56) References Cited

U.S. PATENT DOCUMENTS

| | | | | | |
|---|---|---|---|---|---|
| 2,502,774 | A * | 4/1950 | Alianiello | 36/28 |
| 2,675,633 | A * | 4/1954 | Gaynor | 36/43 |
| 2,797,501 | A * | 7/1957 | Brahm | 36/3 B |
| 2,979,835 | A * | 4/1961 | Scholl | 36/44 |
| 3,170,250 | A * | 2/1965 | Scholl | 36/44 |
| 4,100,686 | A * | 7/1978 | Sgarlato et al. | 36/29 |
| 4,224,746 | A * | 9/1980 | Kim | 36/3 B |
| 4,336,661 | A * | 6/1982 | Medrano | 36/44 |
| 4,369,537 | A * | 1/1983 | Midgley | 12/142 RS |
| 4,571,853 | A * | 2/1986 | Medrano | 36/43 |
| 4,590,689 | A * | 5/1986 | Rosenberg | 36/3 B |
| 4,885,849 | A * | 12/1989 | Lambert | 36/3 B |
| 4,910,882 | A * | 3/1990 | Goller | 36/3 B |
| 5,195,254 | A * | 3/1993 | Tyng | 36/3 R |
| 5,392,533 | A * | 2/1995 | Gerhartl | 36/43 |
| 5,718,064 | A * | 2/1998 | Pyle | 36/28 |
| 6,006,447 | A * | 12/1999 | Neal et al. | 36/3 B |
| 6,280,815 | B1 * | 8/2001 | Ersfeld et al. | 428/71 |
| 6,701,639 | B2 * | 3/2004 | Treptow et al. | 36/2.6 |
| 2002/0017035 | A1 * | 2/2002 | Treptow et al. | 36/2.6 |
| 2004/0107600 | A1 * | 6/2004 | Lin | 36/3 B |
| 2006/0254088 | A1 * | 11/2006 | McCormick | 36/44 |
| 2006/0265900 | A1 * | 11/2006 | Lin | 36/3 B |

* cited by examiner

*Primary Examiner* — Marie Patterson
(74) *Attorney, Agent, or Firm* — Jackson IPG PLLC; Demian K. Jackson

(57) ABSTRACT

An improved structure of ventilating insole, which is composed of a shoe-shaped lower insole, an air permeable layer (cloth or leather) in shoe-shaped and a sponge is placed between the lower insole and the air permeable layer, its features are as follows, a concave trough with casing is set in the central part of the lower insole when molding it in one-body-type, an elastic, porous sponge which is trough-shaped in equal thickness is placed onto the trough of the lower insole, then casing around trough is glued to the air permeable layer with air inlet ports at the heel and air outlet ports at the toe portions, a ventilating insole is then finished. Such an insole provides for pumping cool air into the interior of the shoe as a result of the normal walking action, thus, the shoe can keep ventilating properly.

8 Claims, 9 Drawing Sheets

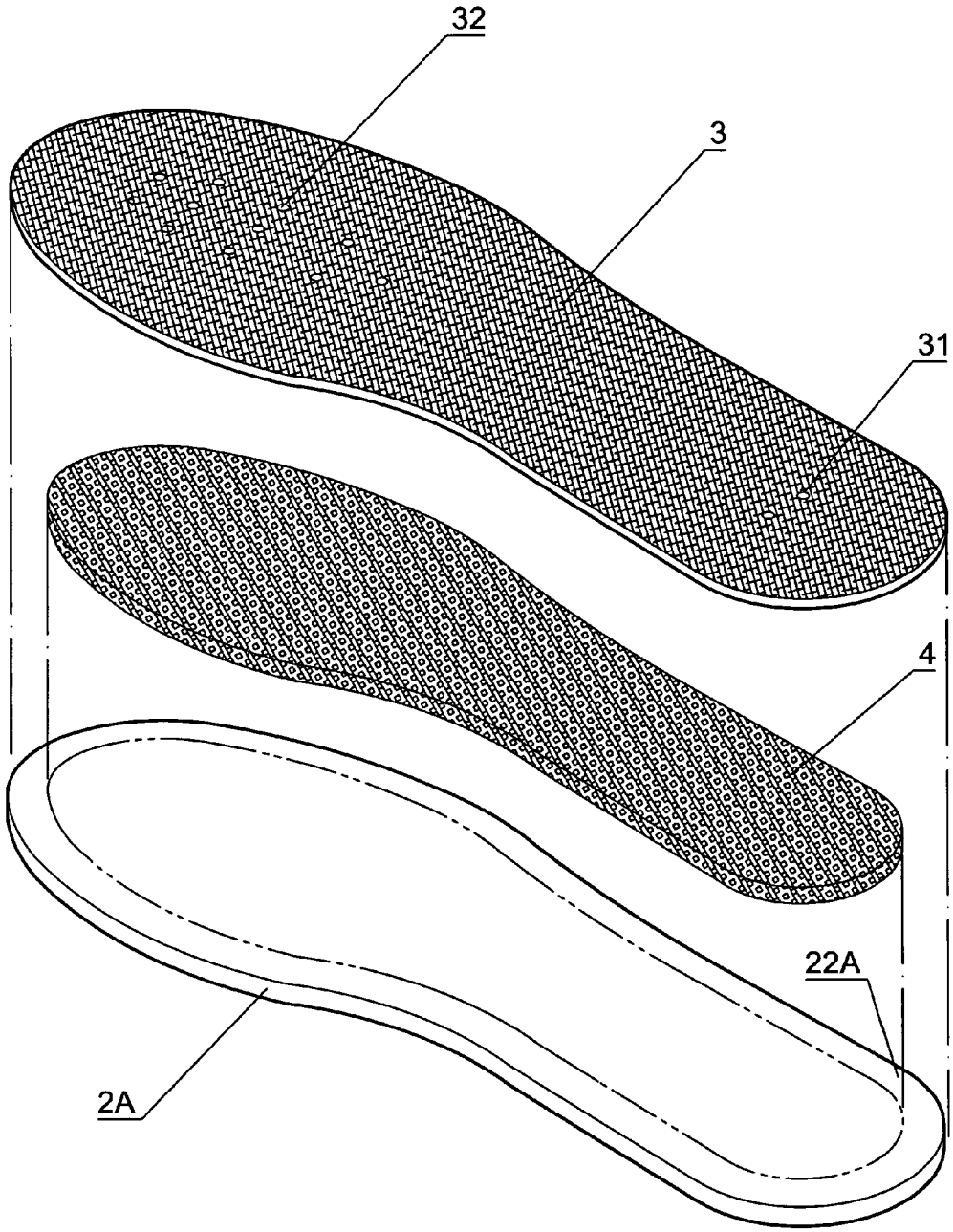
Fig. 1-A

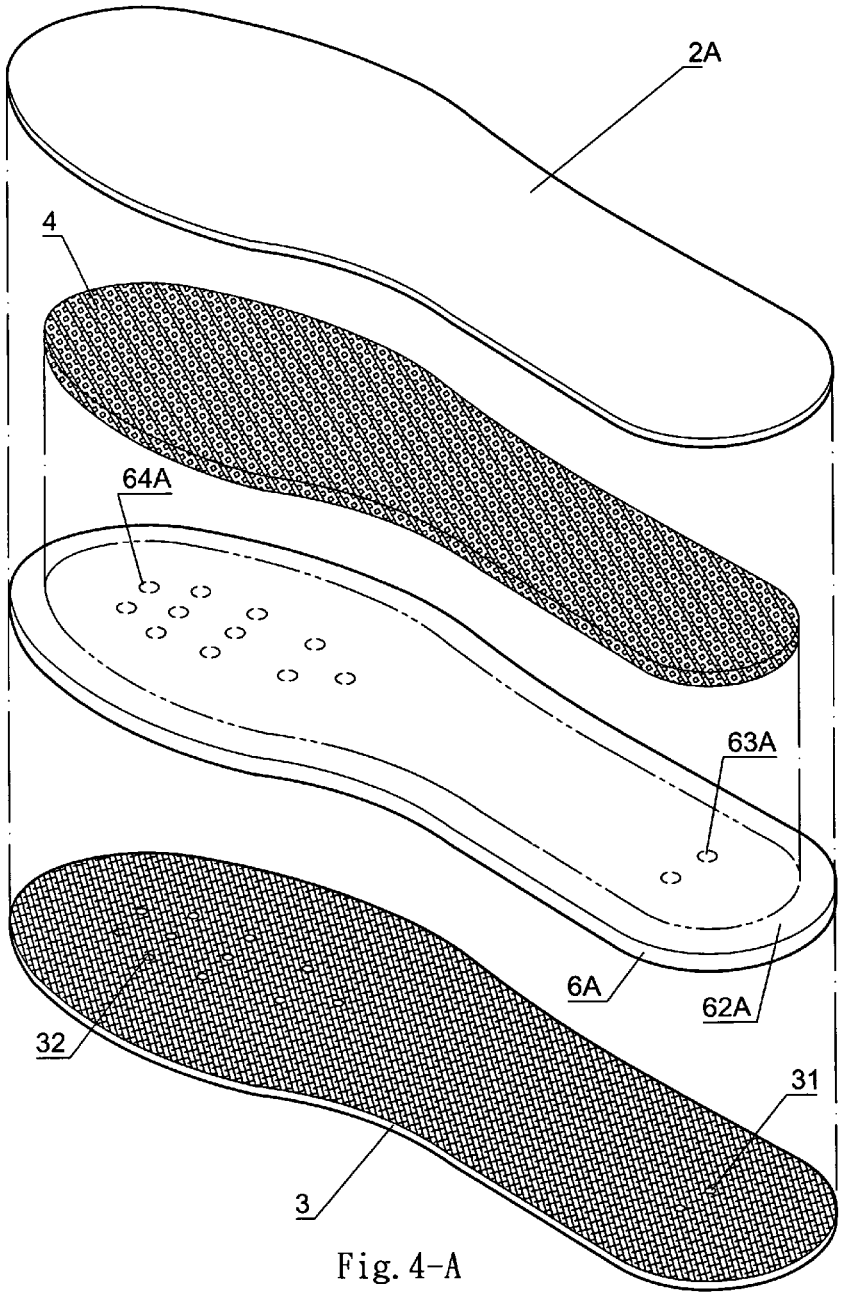
Fig. 4-A

STRUCTURE OF VENTILATING INSOLE

BACKGROUND OF THE INVENTION

1) Field of the Invention

The present invention relates to an improved structure of ventilating insole, which is a concave trough with casing is set in the central part of the lower insole, then place a sponge which is trough-shaped in equal thickness and made of elastic and porous materials onto the trough of the lower insole, the casing around trough is glued to an air permeable layer, so that an air chamber can be formed owing to elasticity of sponge, and air permeable layer are respectively set a plurality of air inlet ports at the heel portion and a plurality of air outlet ports at the toe portion, a ventilating insole is then finished.

Such a ventilating insole provides for pumping cool air into the interior of the shoe as a result of the normal walking action, thus, the shoe keep ventilating properly.

2) Description of the Prior Art

Usually, in the warmer and more humid climates, shoes often ventilate insufficiently so that heat and sweat produced while walking are not easy to get rid of. If wearing shoes for a long time, the wearer might feel uncomfortable. It is easy to multiply mildew and get the annoying athlete's foot. Thus, to solve humidity and heat are the important subject for shoe-making industry. At present, there have been some methods to improve ventilation of shoes, for example: insole with ventilating function, U.S. Pat. No. 4,215,492 issued Aug. 5, 1980; U.S. Pat. No. 5,010,661 issued May 30, 1991; U.S. Pat. No. 5,333,397 issued Aug. 2, 1994, above three types of ventilating insole assembled air chamber at the heel portion of the foot with different methods. Furthermore, said ventilating insole set air inlet ports at the heel or the rear edge of the heel portion, and set air outlet ports at the toe portion of the upper insole or the toes of the foot. The continuous stepping up/down in walking can push cool air around the heel portion of the foot into the toe portion of the foot so as to remove humidity and heat around the toe portion of the foot, owing to air chamber making of elastic material. However, such kinds of air chamber are not large enough, so, air content is limited. If intending to enlarge air contents, it has to increase thickness of insole at heel portion, which is not applicable to common shoes. Another example, the shoe ventilating insole in U.S. Pat. No. 4,224,746 issued Sep. 30, 1980; this type of ventilating insole is composed of an air chamber and a support around air chamber. The air chamber is made of a resilient sponge-like material and an impervious plastic film used to wrap sponge-like material, the top of the air chamber contacts foot, air inlet ports is set at the rear edge of the heel portion and air outlet ports is set at the front of the ball portion thereof. Sponge with smaller holes and high density besieged air chamber as a support of air chamber. Air chamber of this type of ventilating insole only occupies partial space of the insole, so, its air content is less; because the air chamber sets air inlet ports at the rear edge of the heel portion, so, when the wearer is walking, if air inlet ports is not covered by heel, the air in air chamber cannot effectively enter into the toes of the foot. Furthermore, the air chamber and the support around air chamber are produced separately with spongy material in different densities, since insoles have different sizes, so, it may increase difficulty to assemble such ventilating insoles.

In referring to above described data, the applicant herein specially puts forward improved method to make light and thin insole with large air contents, higher ventilating efficiency that is applicable to all types of shoes.

Thus, this inventor has finally succeeded in developing this practical "an improved structure of ventilating insole".

SUMMARY OF THE INVENTION

A first object of this invention is to provide an improved structure of ventilating insole, wherein a concave trough is set in central part of the lower insole which is a piece of plastic material, then place an elastic, porous sponge which is trough-shaped in equal thickness onto the trough and one casing is also set around said trough, which is glued to an air permeable layer which is a piece of cloth or leather, so that an air chamber can be formed between the air permeable layer and the lower insole owing to elasticity of sponge, and air permeable layer are respectively set a plurality of air inlet ports at the heel portion and a plurality of air outlet ports at the toe portion;

Therefore, air can enter into the interior of the shoe when walking and shoe can keep ventilating properly.

A second object of this invention is to provide an improved structure of ventilating insole, wherein structure of this invention is very simple without any other supporting parts such as one-way valve and air duct, insole itself is an air chamber, such insole is light and thin with large air contents, so, it can not only exhaust more air while walking, but also be comfortable to wear.

A third object of this invention is to provide an improved structure of ventilating insole; wherein the lower insole of this invention is molded in one-body-type, so, it saves manpower and material, and further reduces production cost accordingly.

A fourth object of this invention is to provide an improved structure of ventilating insole; wherein sponge is set under air permeable layer so that it is easy to breath and suck up moisture, contact part between the sole of the foot and air permeable layer may produce air convection due to movement of steps, air inlet ports and air outlet ports are respectively set at the heel and toe portions, therefore, cool air around the heel of the foot can enter into the toe portion of the foot, while the wearer is walking, so that humid and hot air in interior of the shoe are easier to be exhausted.

BRIEF DESCRIPTION OF THE DRAWINGS

FIG. 1-A is a three-dimensional exploded view of a shoe insole embodying the present invention showing the lower insole without trough.

FIG. 4-A is a three-dimensional exploded view of another embodiment of the present invention showing the upper insole without trough.

DETAILED DESCRIPTION OF THE PREFERRED EMBODIMENTS

Figure 1:
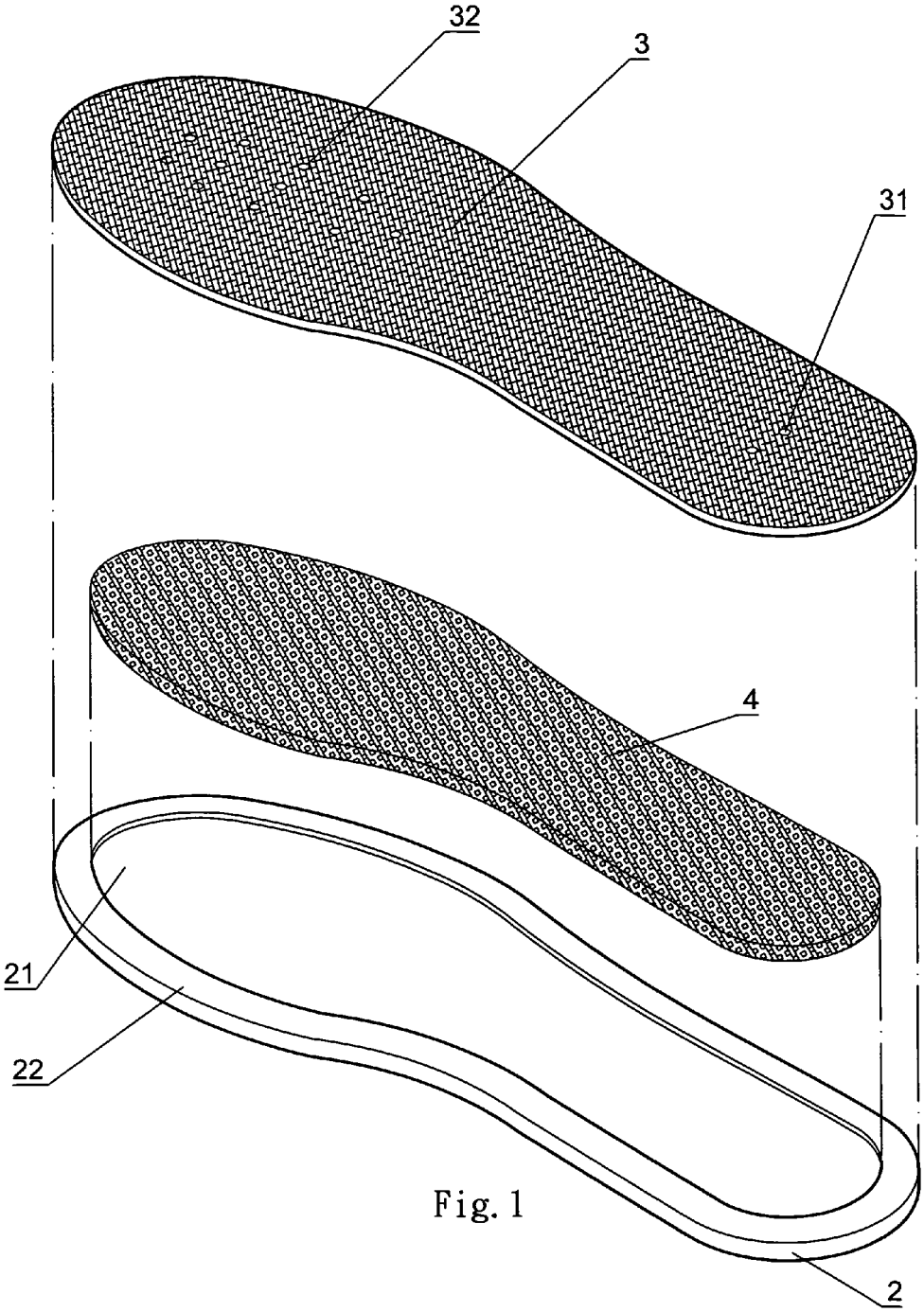
FIG. 1 is a three-dimensional exploded view of a shoe insole embodying the present invention.

We hereby specially describe structure and the preferred embodiments of this invention with examples and drawings in the following. First of all, please refer to FIG. 1, FIG. 1-A, FIG. 2 and FIG. 3, this invention is composed of one-body-type insole with one concave trough 21 at central part as lower insole 2, casing 22 is set around trough 21, elastic, porous sponge 4 with same shape of trough 21 is placed onto trough 21, the sponge 4 is elastic and porous, which can be made of different materials. Then casing 22 around trough 21 is glued to air permeable layer 3 (cloth or leather) with a plurality of air inlet ports 31 at the heel portion P1 and a plurality of air outlet ports 32 at the toe portion P2, so as to form an air chamber S of ventilating insole between the air permeable layer 3 and the lower insole 2.

Please refer to FIG. 1-A for the similar combination in above section, wherein lower insole 2A is not set a trough, a sponge 4 in a shape smaller than the lower insole and equal thickness can be placed the lower insole 2A; then glue casing 22A around sponge 4 between air permeable layer 3 and lower insole 2A, air permeable layer 3 sets air inlet ports 31 and air outlet ports 32 respectively at the heel P1 and at the toe portion P2, sponge 4 is to open up the air permeable layer 3 and the lower insole 2A to form an air chamber of ventilating insole.

Figure 2:
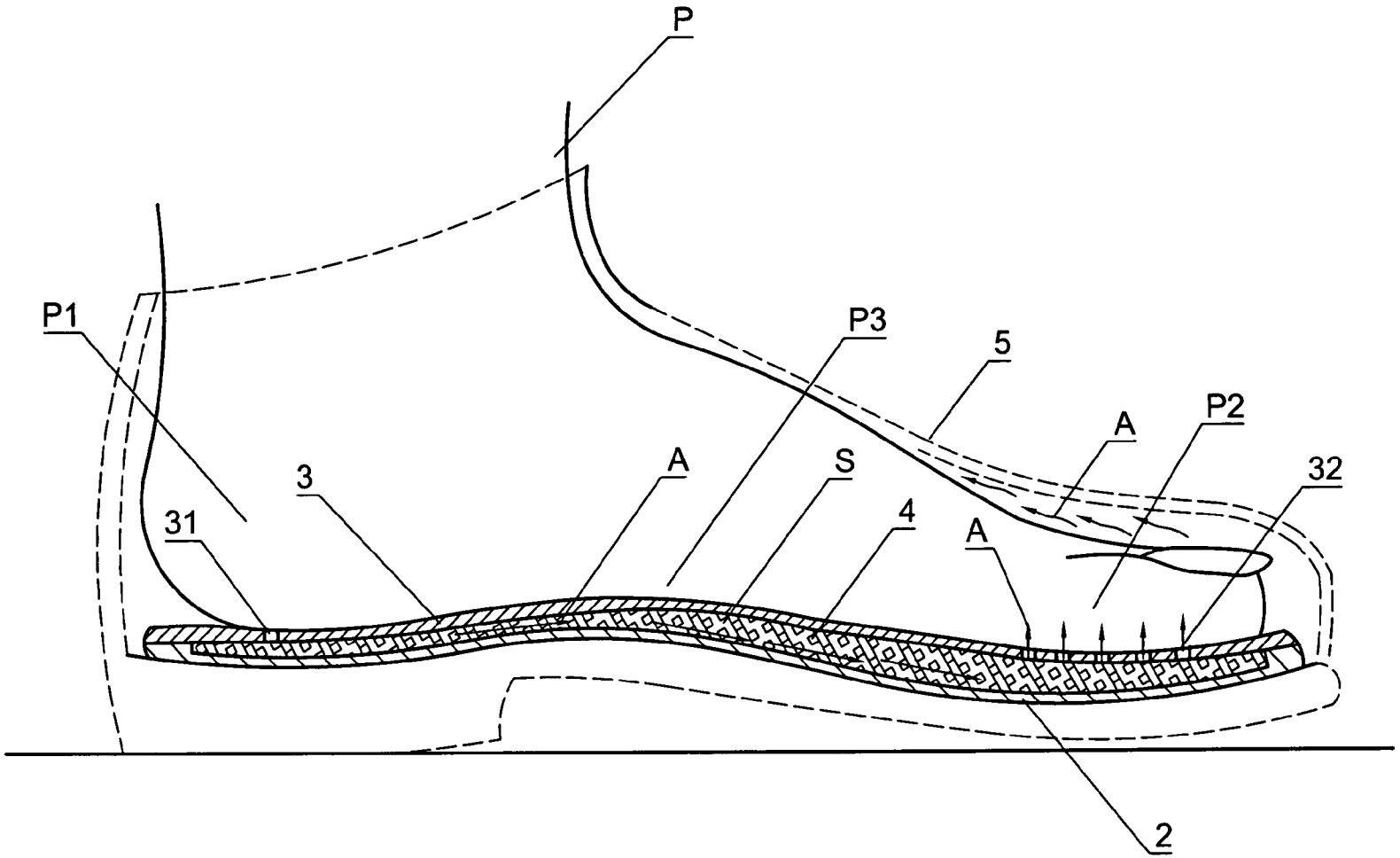
FIG. 2 is a view of the foot and the insole within a shoe with the weight on the heel portion of the foot.
Figure 3:
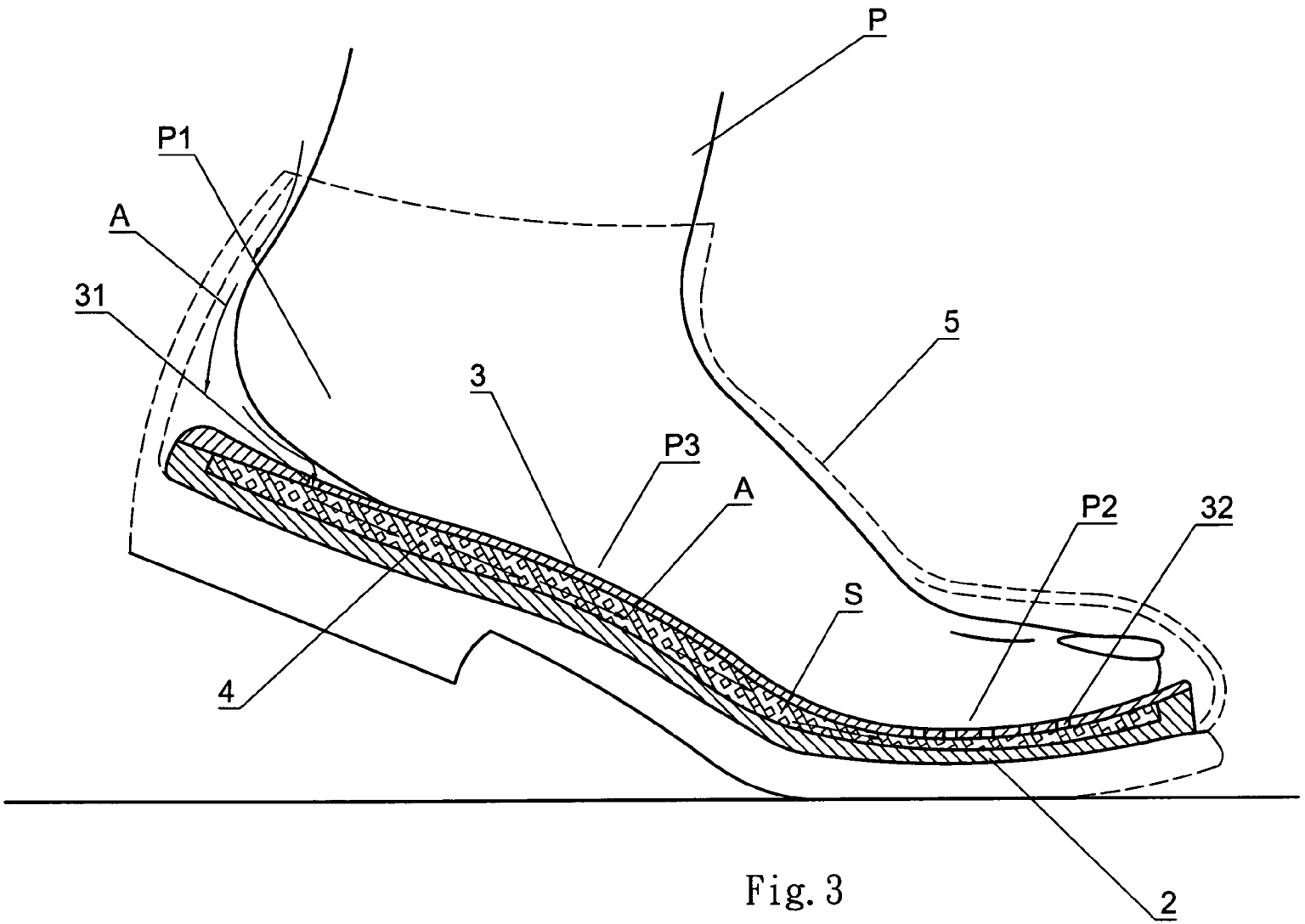
FIG. 3 is a view of the foot and the insole within a shoe with the weight on the toe portion of the foot.

As the wearer is walking, the heel P1 of the foot P first steps down to cover the air inlet ports 31 of the air permeable layer 3, so that the air A inside air chamber S is extruded out from the air outlet ports 32 of the air permeable layer 3, cool air around the heel P1 of the foot then enter into the toe portion P2 to remove humid and hot air at the toe portion P2 so as to keep shoe ventilating (as shown in FIG. 2); as foot P lifts up, its the toe portion P2 covers air outlet ports 32 and the heel P1 first leaves ground, sponge 4 in insole can open up air chamber S, the air inlet ports 31 of the air permeable layer 3 is to inhale outside air A so that air chamber has fresh air continuously, shoe 5 can keep ventilating (as shown in FIG. 3). Such a ventilating insole provides for pumping cool air into the interior of the shoe as a result of the normal walking action, thus, the shoe keeps ventilating properly.

Figure 4:
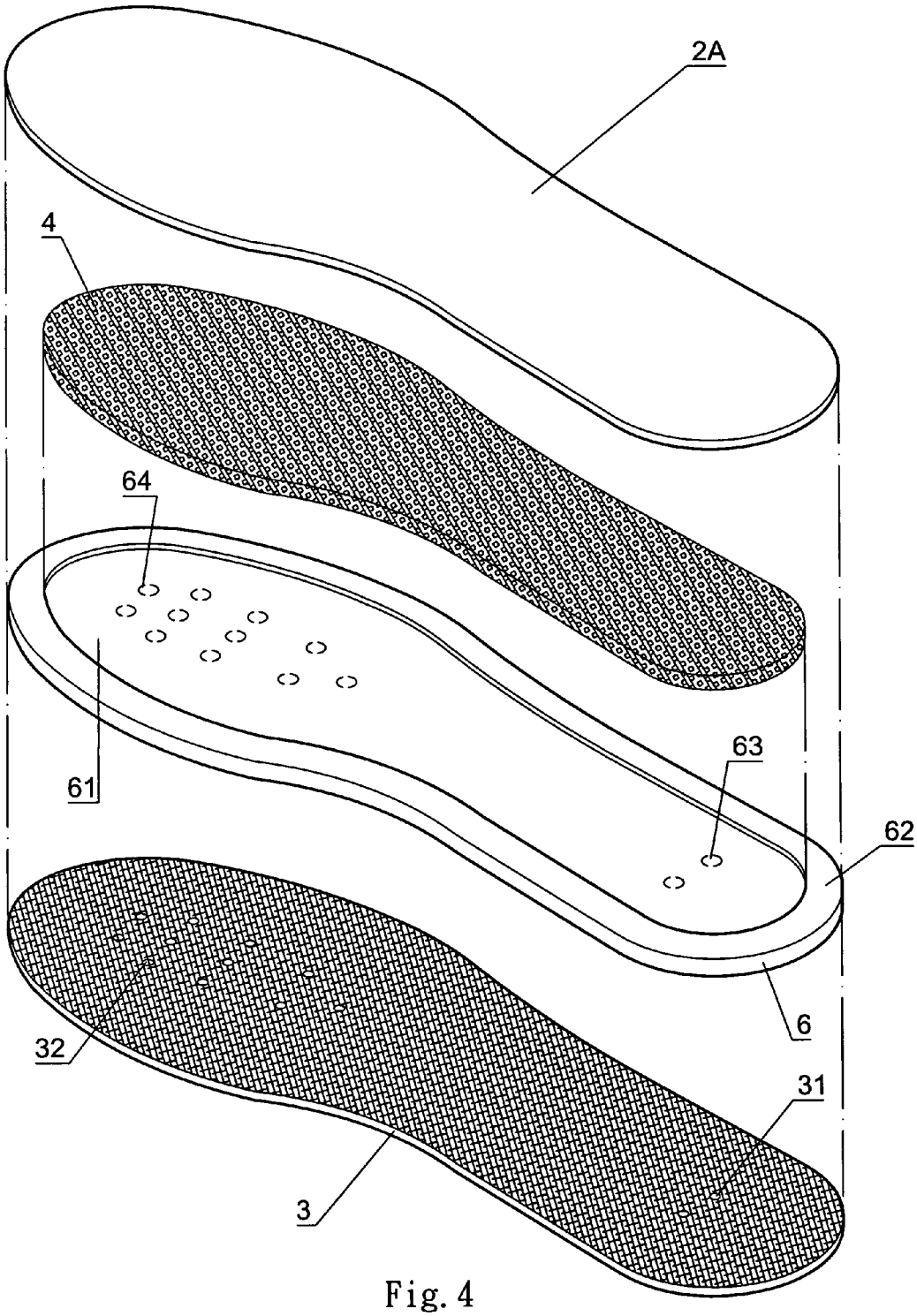
FIG. 4 is a three-dimensional exploded view of another embodiment of the present invention.

As shown in FIG. 4, this invention applies the upper insole 6 which is a piece of plastic material with concave trough at central part in one-body-type, casing 62 is also set around trough 61, then, sponge 4 which is trough-shaped in equal thickness is placed under the trough 61 of the upper insole 6, an air chamber S is formed by gluing the casing 62 of the upper insole 6 to lower insole 2A without trough, an air permeable layer 3 is glued onto the upper insole 6 contacting the sole of the foot, moreover, the upper insole 6 and the air permeable layer 3 set air inlet ports 63,31 at the heel P1 (air inlet ports 63,31 are passable to the air chamber S) and air outlet ports 64,32 at the toe portion P2 (air outlet ports 64,32 are passable to air chamber S), ventilating insole is then finished.

As shown in FIG. 4-A, for the similar combination in above section, wherein the upper insole 6A is not set a trough, the air inlet ports 63A and the air outlet ports 64A are respectively set at the heel P1 and the toe portion P2, and sponge 4 in a shape smaller than the upper insole 6A and equal thickness is also glued to underside of the upper insole 6A, then, glue the casing 62A of the upper insole 6A to the lower insole 2A, air permeable layer 3 is glued to this upper insole 6A contacting the sole of the foot. In addition, both the upper insole 6A and the air permeable layer 3 are set air inlet ports 63A, 31 and air outlet ports 64A, 32 respectively at the heel P1 and the toe portions P2, these air inlet ports 63A, 31 and air outlet ports 64A, 32 are passable to air chamber S, ventilating insole is then finished.

Figure 5:
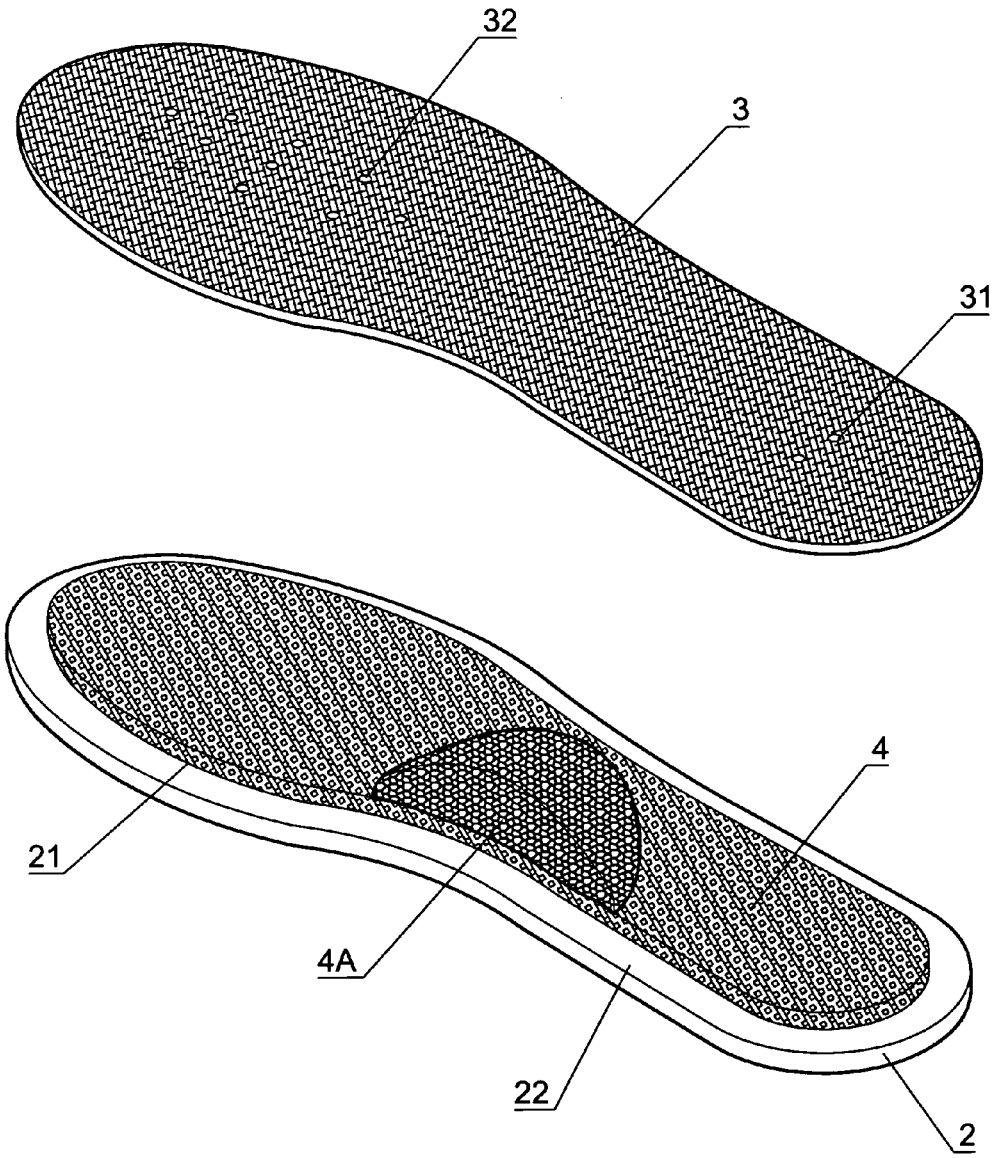
FIG. 5 is a three-dimensional exploded view of the third embodiment of the present invention.

Please refer to FIG. 5, this embodiment is similar in operation to the embodiment previously described and shown in FIG. 1. Additionally, a sponge 4A matching to the arch of the foot glued onto sponge 4 at the arch that can open up air chamber so as to enlarge room of air chamber S.

Figure 6:
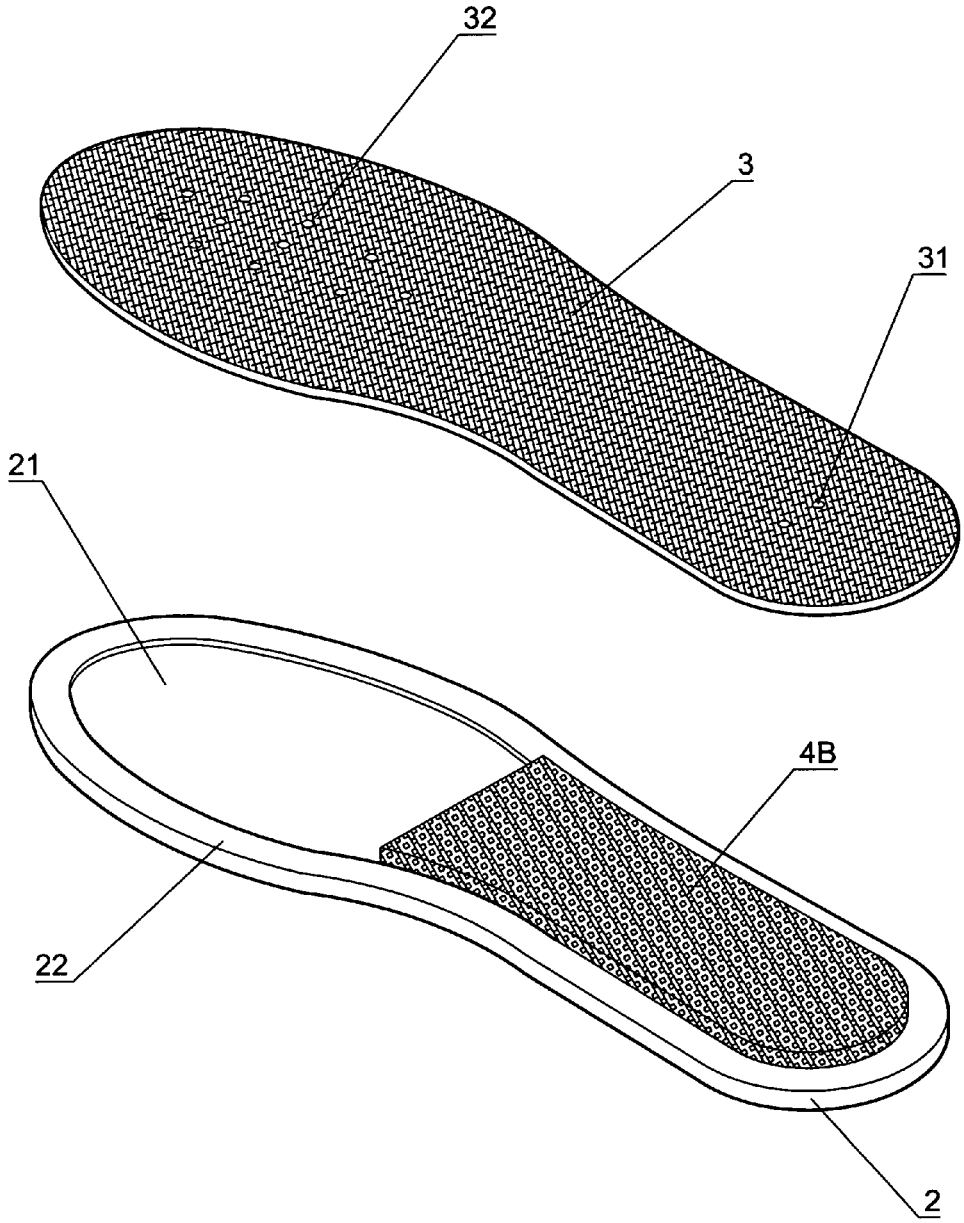
FIG. 6 is a three-dimensional exploded view of the fourth embodiment of the present invention.
Figure 7:
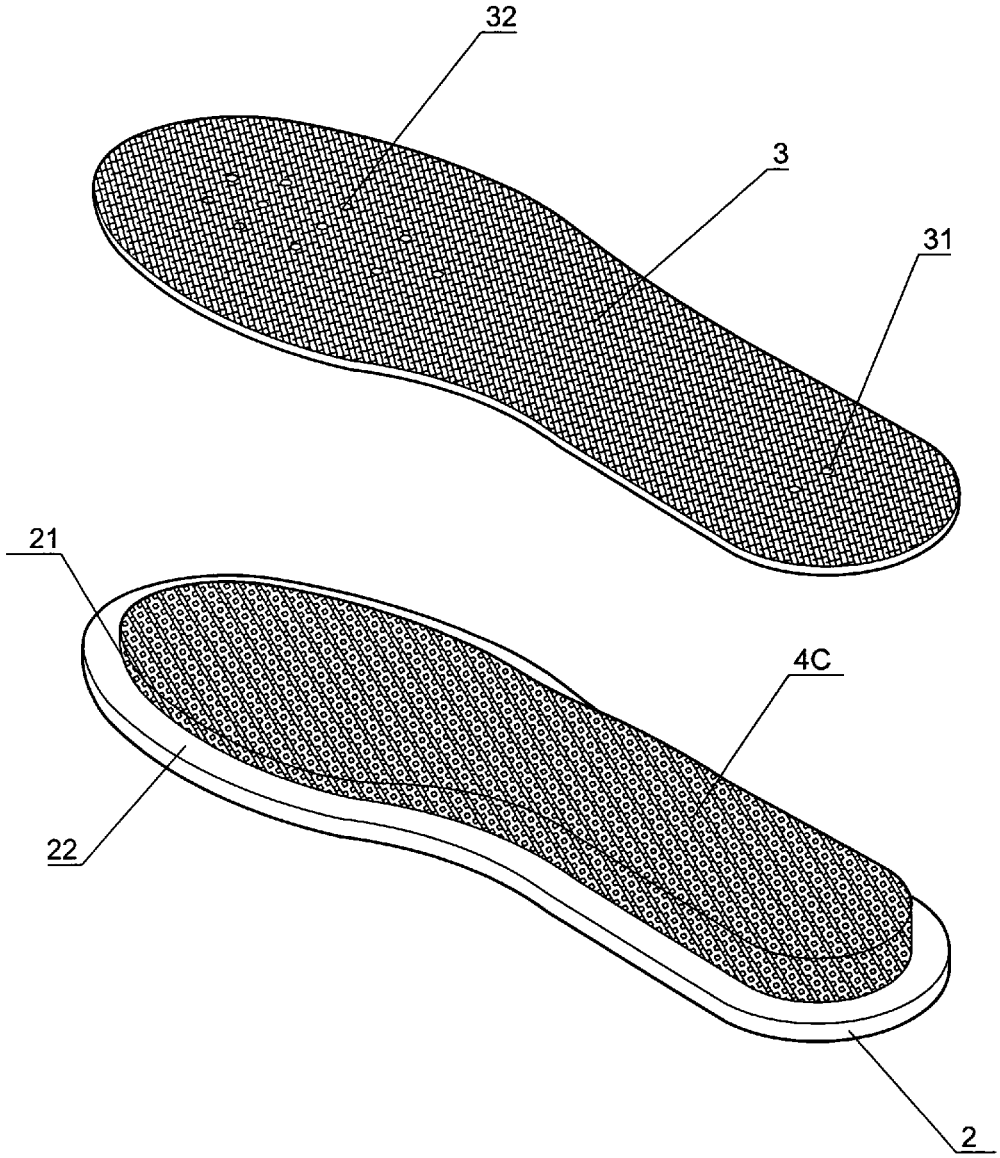
FIG. 7 is a three-dimensional exploded view of the fifth embodiment of the present invention.

Please refer to FIG. 6 and FIG. 7, this embodiment is similar in operation to the embodiment previously described and shown in FIG. 1 except sponge 4 can be replaced by a half shaped sponge 4B extending from the arch P3 to the heel P1, or can be replaced by a sponge 4C which is thin at the toe portion P2 and thick at heel P1.

What is claimed is:

1. A ventilating insole assembly comprising:

an air permeable layer comprising a plurality of air inlet ports at a heel portion and a plurality of air outlet ports at a toe portion;

a lower insole comprising a casing set around a central area of the lower insole; and a sponge which is shaped and sized to fit within the casing and wherein the sponge is of constant thickness and comprises elastic and porous materials wherein the air permeable layer is glued to the casing of the lower insole so as to form an air chamber such that cool air around the heel portion of a user's foot is drawn and forced by weight of the user's foot into the toe portion through the air chamber and air outlet ports so as to remove humid and hot air at the toe portion of the foot, wherein the lower insole further comprises a concave trough set in a central part thereof with the casing extending around the concave trough and wherein the sponge is shaped and sized to match the concave trough, wherein the sponge is sized and shaped to extend only from an arch portion to the heel portion.

2. The ventilating insole assembly of claim 1, wherein the ventilating insole assembly is a removable single insole or is directly fixed inside a shoe.

3. The ventilating insole assembly of claim 1, wherein the ventilating insole assembly is a removable single insole or is directly fixed inside a shoe.

4. A ventilating insole assembly comprising:

an air permeable layer comprising a plurality of first air inlet ports at a heel portion and a plurality of first air outlet ports at a toe portion of the air permeable layer;

an upper insole insole comprising a casing set around a central area of the lower insole and a plurality of second air inlet ports and a plurality of second air outlet ports corresponding respectively to the first air inlet ports and first air outlet ports of the air permeable layer wherein the air permeable layer is glued to the upper insole opposite the casing;

a lower insole sized and shaped to match the casing; and a sponge which is shaped and sized to fit within the casing and wherein the sponge is of constant thickness and comprises elastic and porous materials wherein the lower insole is glued to the casing of the upper insole so as to form an air chamber such that cool air around the heel portion of a user's foot is drawn and forced by weight of the user's foot into the toe portion through the air chamber and air outlet ports so as to remove humid and hot air at the toe portion of the foot, wherein the upper insole further comprises a concave trough set in a central part thereof with the casing extending around the concave trough and wherein the sponge is shaped and sized to match the concave trough, wherein the sponge is sized and shaped to extend only from an arch portion to the heel portion.

5. The ventilating insole assembly of claim 4, wherein the ventilating insole assembly is a removable single insole or is directly fixed inside a shoe.

6. The ventilating insole assembly of claim 4, wherein the ventilating insole assembly is a removable single insole or is directly fixed inside a shoe.

7. A ventilating insole assembly comprising:

an air permeable layer comprising a plurality of first air inlet ports at a heel portion and a plurality of first air outlet ports at a toe portion of the air permeable layer;

an upper insole insole comprising a casing set around a central area of the lower insole and a plurality of second air inlet ports and a plurality of second air outlet ports corresponding respectively to the first air inlet ports and first air outlet ports of the air permeable layer wherein the air permeable layer is glued to the upper insole opposite the casing;

a lower insole sized and shaped to match the casing; and a sponge which is shaped and sized to fit within the casing and wherein the sponge is of constant thickness and comprises elastic and porous materials wherein the lower insole is glued to the casing of the upper insole so as to form an air chamber such that cool air around the heel portion of a user's foot is drawn and forced by weight of the user's foot into the toe portion through the air chamber and air outlet ports so as to remove humid and hot air at the toe portion of the foot, wherein the upper insole further comprises a concave trough set in a central part thereof with the casing extending around the concave trough and wherein the sponge is shaped and sized to match the concave trough, further comprising a supplemental sponge with a contour matching the arch of the foot placed onto the sponge so as to enlarge a volume of the air chamber.

8. A ventilating insole assembly comprising:

an air permeable layer comprising a plurality of air inlet ports at a heel portion and a plurality of air outlet ports at a toe portion;

a lower insole comprising a casing set around a central area of the lower insole; and a sponge which is shaped and sized to fit within the casing and wherein the sponge is of constant thickness and comprises elastic and porous materials wherein the air permeable layer is glued to the casing of the lower insole so as to form an air chamber such that cool air around the heel portion of a user's foot is drawn and forced by weight of the user's foot into the toe portion through the air chamber and air outlet ports so as to remove humid and hot air at the toe portion of the foot, wherein the lower insole further comprises a concave trough set in a central part thereof with the casing extending around the concave trough and wherein the sponge is shaped and sized to match the concave trough, further comprising a supplemental sponge with a contour matching the arch of the foot placed onto the sponge so as to enlarge a volume of the air chamber.

* * * * *